US005655828A

United States Patent [19]

Yamamoto et al.

[11] Patent Number: 5,655,828

[45] Date of Patent: Aug. 12, 1997

[54] VEHICLE LAMP AND A METHOD OF FORMING A REFLECTOR OF THE VEHICLE LAMP

[75] Inventors: Norimasa Yamamoto; Hideyuki Aihara, both of Shizuoka, Japan

[73] Assignee: Koito Manufacturing Co., Ltd., Tokyo, Japan

[21] Appl. No.: 604,242

[22] Filed: Feb. 21, 1996

[30] Foreign Application Priority Data

Feb. 24, 1995 [JP] Japan ..... 7-060153

[51] Int. Cl.[6] ..... F21V 7/06

[52] U.S. Cl. ..... 362/61; 362/297; 362/346; 362/348

[58] Field of Search ..... 362/61, 80, 297, 362/296, 346, 348

[56] References Cited

U.S. PATENT DOCUMENTS

| | | | |
|---|---|---|---|
| 1,726,379 | 8/1929 | Benford | 362/297 |
| 1,903,417 | 4/1933 | Grant | 362/304 |
| 3,700,882 | 10/1972 | Planchon | 362/348 |
| 3,700,883 | 10/1972 | Donahue et al. | 362/61 |
| 4,351,018 | 9/1982 | Fratty | 362/346 |
| 4,417,300 | 11/1983 | Bodmer | 362/304 |
| 4,495,552 | 1/1985 | Graff | 362/297 |
| 4,608,512 | 8/1986 | Rakitsch | 313/113 |
| 5,034,867 | 7/1991 | Mayer | 362/297 |
| 5,406,464 | 4/1995 | Saito | 362/61 |
| 5,532,909 | 7/1996 | Ban et al. | 362/61 |

FOREIGN PATENT DOCUMENTS

| | | | |
|---|---|---|---|
| 2262980 | 7/1993 | United Kingdom | F21V 7/09 |

*Primary Examiner*—Alan Cariaso

*Attorney, Agent, or Firm*—Sughrue, Mion, Zinn, Macpeak & Seas

[57] ABSTRACT

A reference parabola is drawn in a vertical plane containing a principal optical axis of a reflector. A reference point of a curve demarcating the right side of a peripheral region of the reflector is set in the horizontal plane containing the principal optical axis. A boundary line of the peripheral region, which is extended along a design line of an outer lens when viewed from the side of a vehicle lamp, is drawn. The end points of the boundary line, and the end points of the reference parabola are determined by an external frame defining outer lines of the reflector viewed from the front side thereof. Of those points, the associated ones are connected by circular arcs, to thereby form a curved surface. The peripheral region forms a part of the curved surface. A region of the reflector intersecting the principal optical axis and continuous to the peripheral region is shaped to have a paraboloid of revolution. A plurality of paraboloids of revolution with different focal distances are set for the peripheral region, to thereby determine intersecting lines where the peripheral region intersects the paraboloids of revolution. A plurality of reflecting steps are disposed on the peripheral region between the adjacent intersecting lines. The reflecting steps are defined by parts of the paraboloids of revolution.

3 Claims, 13 Drawing Sheets

VEHICLE LAMP AND A METHOD OF FORMING A REFLECTOR OF THE VEHICLE LAMP

BACKGROUND OF THE INVENTION

The present invention relates to a vehicle lamp improved such that a reflector of the vehicle lamp has no nonreflecting part in the peripheral region of the reflecting surface of the reflector, and the vehicle lamp has a good appearance viewed from the side, and also relates to a method of forming such a reflector.

In recent design of car shapes, a designer is requested to variously design the shape of the vehicle lamp in conformity with a shape of a car. An example of the rear combination lamp a for vehicles is illustrated in FIG. 15. The side faces of the rear combination lamp a when viewed horizontally are curved in conformity with the shape of a car. A tail and stop lamp b occupies the top of the rear combination lamp a. The front face of the lamp b is substantially triangular in shape. The side face thereof is also substantially triangular. The side face is curved to the side of the car.

FIG. 16 is a perspective view schematically showing the tail and stop lamp b. A major portion e of an outer lens d is greatly slanted with respect to the vertical direction. A peripheral wall f of the major portion e is curved from the major portion e to the side at a relatively large curvature.

A reflector g is substantially triangular when viewed from the front side, as shown in FIG. 17. A light source h is placed at the focal point of the reflecting surface of the reflector g. The reflecting surface takes the form of a paraboloid of revolution.

In the vehicle lamp thus constructed, most of the reflecting surface serves as an effective reflecting area. However, a peripheral part close to and along the shortest side of the reflector g does not contribute to the reflection of light. This peripheral part or nonreflecting part is denoted as i and shaded in FIGS. 16 and 17. Because of the presence of the nonreflecting part i, there is a limit in further improvement of the utilization of the luminous flux. Further, the nonreflecting part i impairs the appearance of the vehicle lamp.

FIG. 18 is a horizontal sectional view showing a main portion of the tail and stop lamp b, taken along a line horizontally extended at a level closer to the top of the lamp b. As shown, the peripheral part of the reflector g is bent to be shaped like L, thereby forming a nonreflecting part i. A lens mounting portion j, which is continuous to the nonreflecting part i, has a groove k. The edge portion of the peripheral wall f of the tail and stop lamp b is inserted into the groove k of the lens mounting portion j.

No light from the light source h irradiates the nonreflecting part i. The nonreflecting part i serves as a nonluminous part (shaded in the figure) when viewed from the side, as shown in FIG. 19. A boundary line l between the nonreflecting part i and the effective reflecting portion is not in harmony with a design line m of the outer lens d, in shape. Accordingly, the appearance of the lamp viewed from the side of the car is not attractive when the lamp is lit on.

SUMMARY OF THE INVENTION

To solve the above problems, according to the present invention, there is provided a vehicle lamp including a reflector having such a reflecting surface that a first region of the reflecting surface, which intersects with a principal optical axis of the reflector, is curved to have a paraboloid of revolution, a peripheral region of the reflecting surface, which is located adjacent to the first region, is curved to have a free curved surface, and a plural number of reflecting steps are formed on the peripheral region, an outer lens covering an opening of the reflector, and a light source disposed at a focal position or its near position of the first region of the reflecting surface, characterized in that the peripheral region of the reflector is continuous to the first region, a boundary line of the peripheral region is shaped along a design line of the outer lens when viewed from the side of the vehicle lamp, and a plurality of reflecting steps are disposed on the peripheral region along and between intersecting lines at which the peripheral region intersects a plurality of paraboides of revolution with different focal distances, the steps being defined by parts of the paraboloids of revolution.

The reflector of the vehicle lamp thus constructed is formed by a method comprising the following steps of:

1) drawing a reference parabola of the same focal point as of the first region in a vertical plane containing the principal optical axis of the reflector;

2) determining a reference point of a boundary line between a lens mounting portion for mounting the outer lens and the peripheral region in a horizontal plane containing the principal optical axis of the reflector;

3) setting up the boundary line of the peripheral region along a design line of the outer lens when viewed from the side of the vehicle lamp, the boundary line passing through the reference point determined in step 2) above;

4) determining the end points of the boundary line determined in step 3) above on the basis of the boundary line and the external frame of the reflector when viewed from the front side thereof;

5) determining the end points of the reference parabola and a point where the horizontal plane containing the principal optical axis intersects the reference parabola, on the basis of the external frame of the reflector viewed from the front side and the reference parabola drawn in step 1) above;

6) connecting, by circular arcs, the associated points in the vertical direction, the points including the reference point determined in step 2) above, the end points determined in step 4) and the end points and the intersecting point determined in step 5) above;

7) generating a curved surface on the basis of the circular arcs used in step 6), the reference parabola drawn in step 1), and the boundary line set up in step 3) above;

8) obtaining a line of intersection of the curved surface generated in step 7) above and the paraboloid of revolution of which the focal point and the focal distance are the same as those of the first region, to thereby determine a boundary line between the first region and the peripheral region, whereby the first region is curved to have the paraboloid of revolution, and the peripheral region forms a part of the curved surface generated in step 7);

9) setting a group of paraboloids of revolution consisting of a plurality of paraboloids of revolution with different focal distances for the peripheral region;

10) determining a group of intersecting lines where the peripheral region intersects the paraboloids of revolution; and 11) defining a plurality of reflecting steps by parts of the paraboloids of revolution, the reflecting steps being disposed on the peripheral region along the intersecting lines and between the adjacent intersecting lines.

In the vehicle lamp of the present invention, the first region is curved to have the paraboloid of revolution. The peripheral region continuous to the first region is shaped to have a curved surface obtained by smoothly connecting a space between the boundary line at one end of the peripheral region, which divides the peripheral region from the first region, and the boundary line at the other end of the peripheral region, which extends along the design line of the outer lens, so that a part shaded to light from the light source is not formed on the peripheral region of the reflecting surface. A plurality of reflecting steps are disposed on the peripheral region along intersecting lines at which the peripheral region intersects a plurality of paraboloides of revolution, and between adjacent ones of the intersecting lines. The reflecting steps are defined by parts of the paraboloids of revolution. With the provision of the reflecting steps, light beams are directed in parallel with the principal optical axis. Thus, nonreflecting part is not created in the peripheral region of the reflecting surface. Additionally, the boundary line of the peripheral region is shaped along the design line of the outer lens when viewed from the side of the vehicle lamp.

BRIEF DESCRIPTION OF THE DRAWINGS

FIG. 9 shows a fundamental surface.

DETAILED DESCRIPTION OF THE INVENTION

Preferred embodiments of a vehicle lamp according to the present invention and a method of forming a reflector of the vehicle lamp according to the present invention will be described with reference to the accompanying drawings. In the description to follow, the vehicle lamp of the present invention is embodied in the form of a tail and stop lamp.

Figure 1:
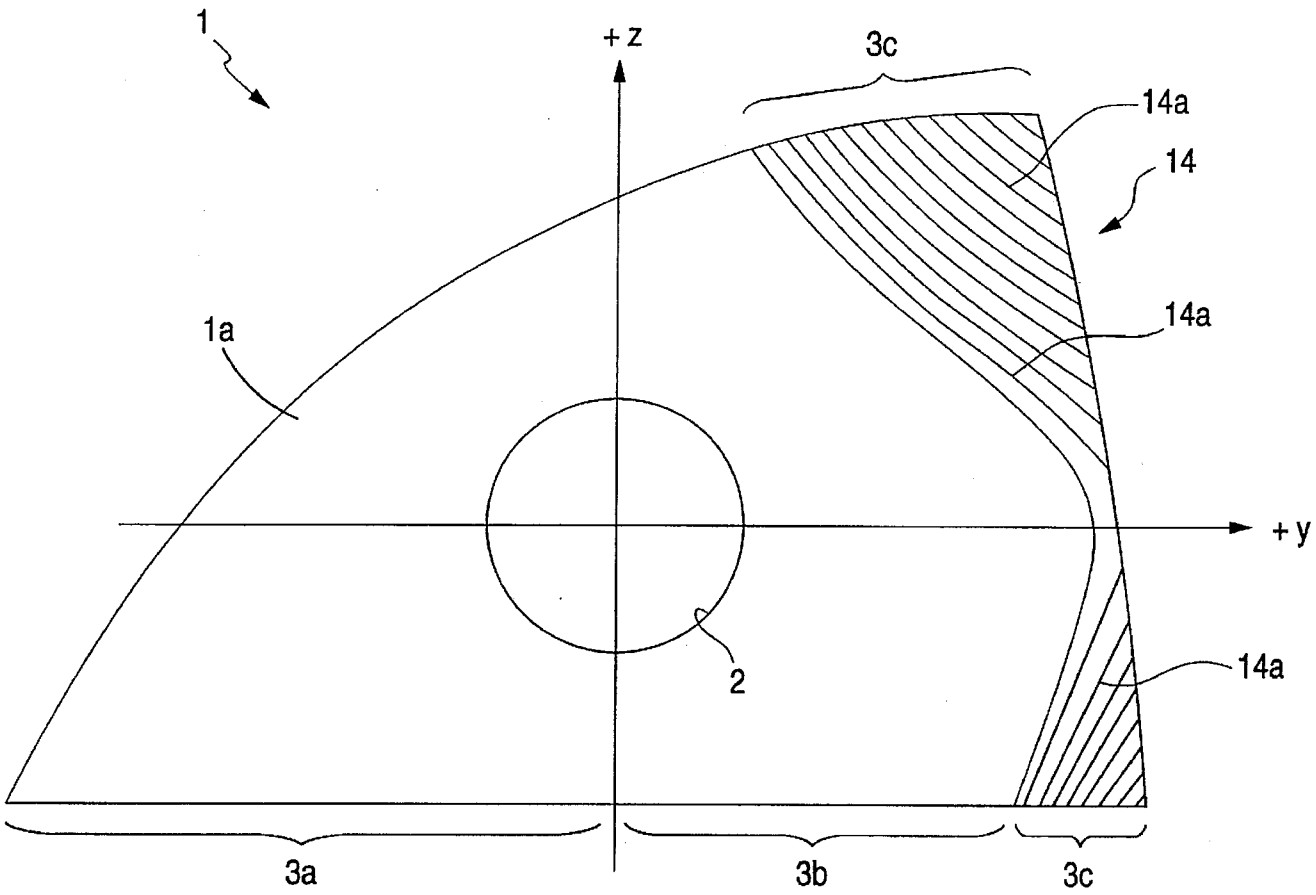
FIG. 1 is a front view showing a reflecting surface of a reflector of the present invention.

FIG. 1 is a front view showing the front shape of a reflector 1 to be assembled into a vehicle lamp according to the present invention. As shown, a circular hole 2 as a bulb insertion hole is formed at the central part of the reflector 1 that is substantially triangular. A principal optical axis of the reflector passes trough the hole and the reflector is designed to direct the light from a bulb in parallel with the principal optical axis. In the Cartesian coordinates applied to the reflector 1, the x-axis passes through the center of the circular hole 2 and is extended in the direction of the principal optical axis (viz., in the direction perpendicular to the paper surface of the drawing) of the reflector 1 (the positive direction of the x-axis is the direction turned to this side on the paper surface of the drawing). The y-axis is perpendicular to the x-axis, and passes through the center of the circular hole 2 and is horizontally extended (the positive direction of the y-axis is the direction turned to the right). The z-axis is perpendicular to the x-axis and the y-axis, and passes through the center of the circular hole 2 and is extended in the vertical direction (the positive direction of the z-axis is the direction turned to the upper side).

The reflecting surface la of the reflector 1 may be divided into three light distribution control regions. A region **3*a* on the left side of the x-z plane when viewed from the front side of the reflector 1 is curved to have a paraboloid of revolution of a focal distance fa. A region 3*b*** on the right side of the x-z plane when viewed in the same direction is curved to have a paraboloid of revolution of a focal distance fb. The focal point is made common to both the regions.

A peripheral region **3*c* of the reflecting surface 1*a*, which is continuous to the right side of the region 3*b*** and is a curved part of the lamp, has a so-called free curved surface which cannot be strictly described by the analytical expression. The free surface is used as a fundamental surface. A plural number of reflecting steps are formed on the fundamental surface, to thereby form a composite surface.

The region **3*a*, which occupies the left half of the reflecting surface 1*a*, is curved to have the paraboloid of revolution, and the method of forming the left half of the reflector is known. Thus, with reference to FIGS. 2 to 14, design of the shape of the right half of the reflecting surface 1*a* will be described in two steps: a first step is to form the fundamental surface which provides the ground of the right half shape, and a second step is to form reflecting steps on the peripheral region 3*c***.

FIGS. 2 through 8 show a sequence of procedural steps of forming the fundamental surface.

(a1) To draw a reference parabola of the focal distance fa in a vertical plane VP containing the x-axis.

Figure 2:
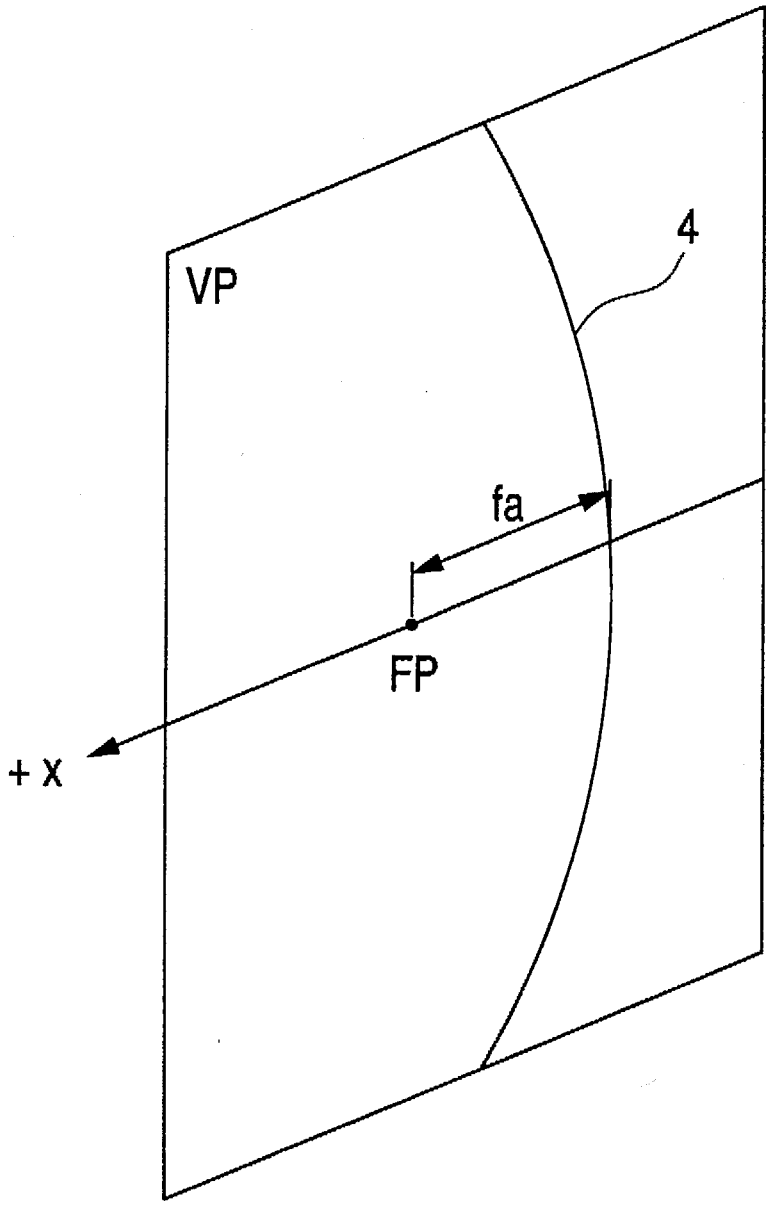
FIG. 2 is, together with FIGS. 3 to 8, a schematic view for explaining the formation of the right half of a reflecting surface of the present invention, and of these figures, FIG. 2 perspectively shows a reference parabola set in the vertical plane containing a principal optical axis.

To start with, a reference parabola 4 which has the focal point FP on the x-axis and the focal distance fa is drawn in the x-z plane (FIG. 2). If required, the focal distance of the reference parabola drawn upper the x-axis in the vertical plane VP may be made different from the reference parabola drawn lower the x-axis.

(a2) To determine a position of the lens mounting portion (formed in the peripheral region of the reflecting surface 1*a*) in a horizontal plane.

Figure 3:
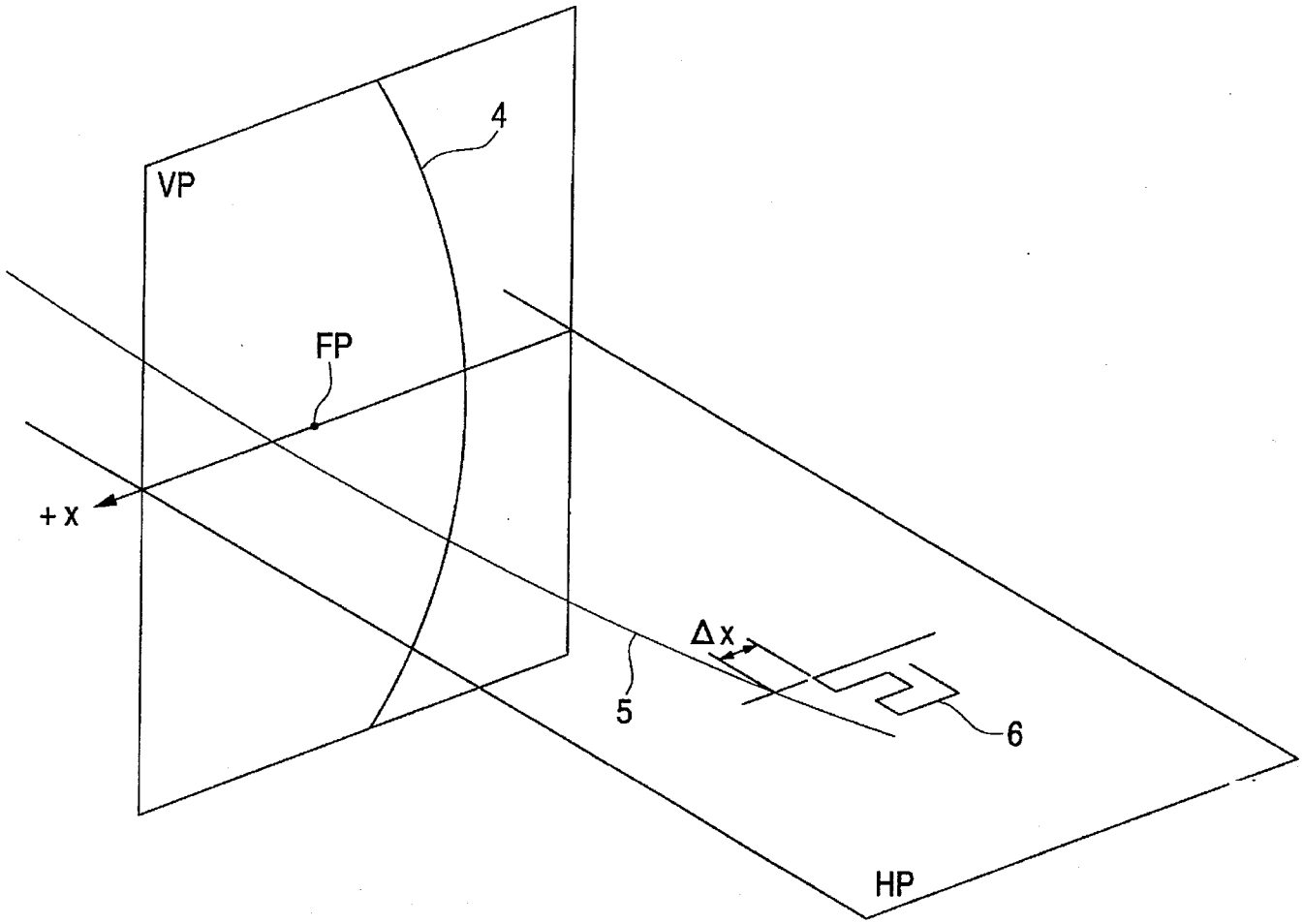
FIG. 3 is a perspective view showing how to position a lens mounting portion in the horizontal plane containing the principal optical axis.
Figure 4:
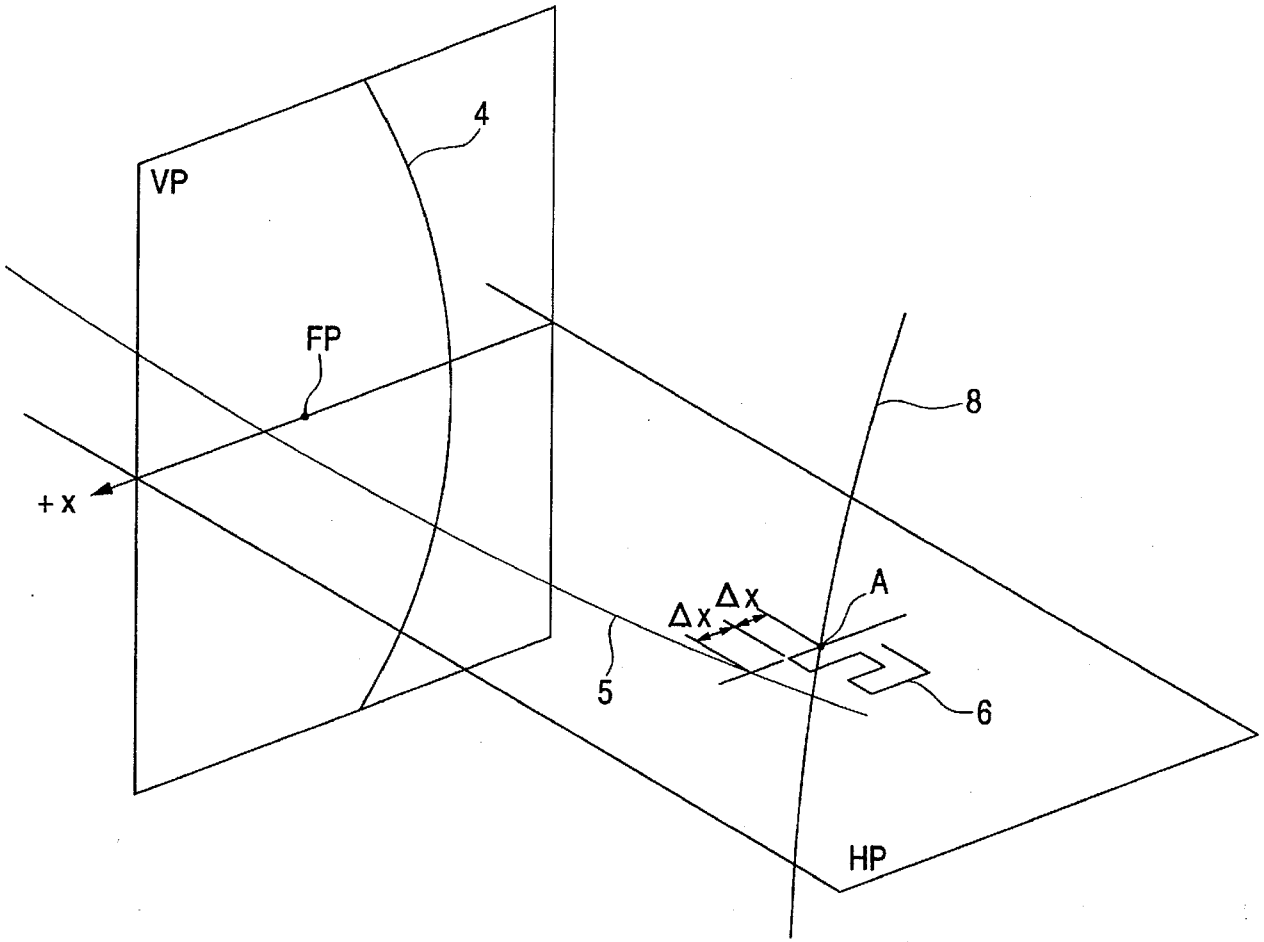
FIG. 4 is a perspective view showing a line representative of the right side of the reflecting surface, which is set within the lens mounting portion.

In FIG. 3, a curve 5 indicates the line of intersection of the inner surface of the outer lens and a horizontal surface HP (viz., x-y plane) containing the x-axis. A lens mounting portion 6 is positioned such that the end of the lens mounting portion 6 is placed at a position distanced Δx from the curve 5 to the rear (in the negative direction of the x-axis). A point A is set at a position distanced further Δx to the rear (FIG. 4). The point A lies within the lens mounting portion 6, and is a reference point of a curve demarcating the right side of the reflecting surface 1*a*.

(a3) To set up a curve extending along a design line of the outer lens.

Figure 5:
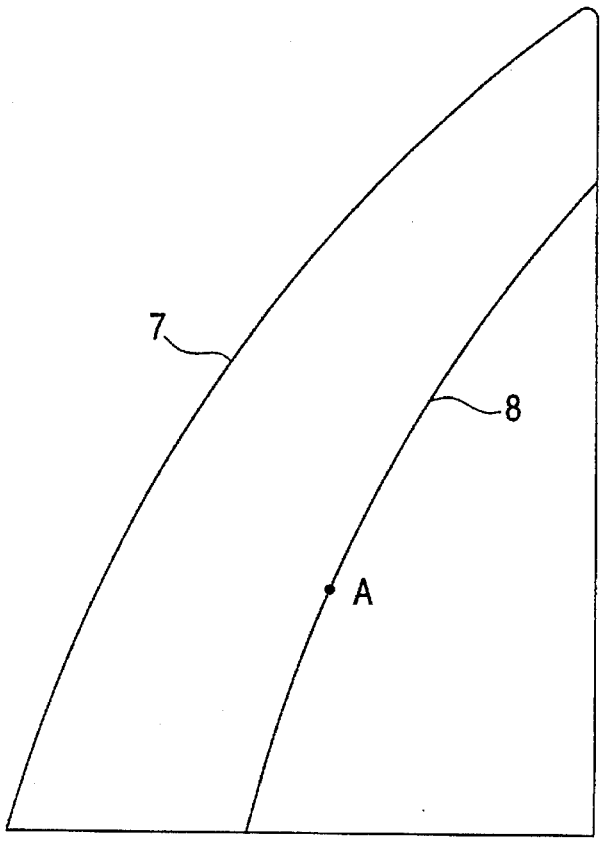
FIG. 5 is a side view showing the relationship of the right-side defining line of the reflecting surface and a design line of the outer lens.

FIG. 5 is a diagram showing the vehicle lamp viewed from the side thereof. In the figure, a curve 7 represents a design line (part of an external form line) of the outer lens. A curve 8, which passes through the point A and is curved at a curvature substantially equal to that of the curve 7, is drawn. The curve 8 demarcates the right side of the reflecting surface 1*a*.

(a4) To determine the upper and the lower end points of the curve 8.

Figure 6:
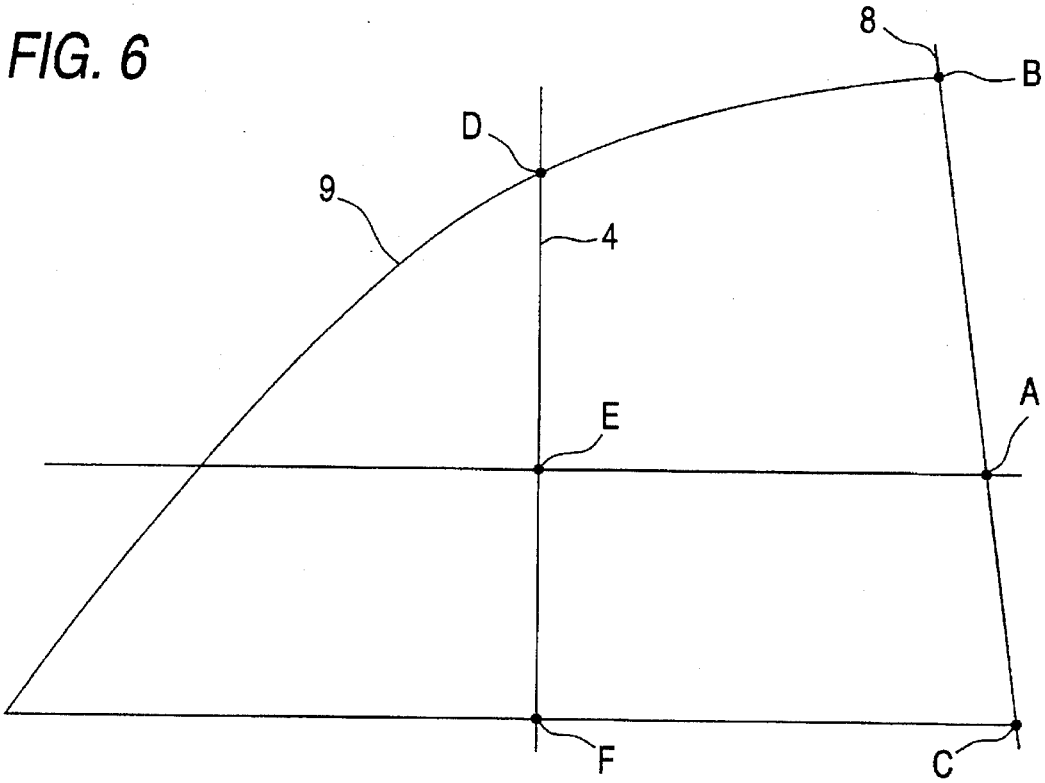
FIG. 6 is a front view showing the positions determined by an external frame of the reflecting surface, the right-side defining line of the reflecting surface, and the reference parabola.

As shown in FIG. 6, the upper end point B and the lower end point C of the curve 8 are determined by using an external frame 9 defining an external form of the front of the reflecting surface 1*a*, and the curve 8. The upper end point B and the lower end point C are determined as points where the curve 8 intersects a curved surface which includes the external frame 9 and extends in parallel with the x-axis.

(a5) To determine the upper and the lower end points and a mid point of the reference parabola 4.

As shown in FIG. 6, the upper end point D and the lower end point F of the reference parabola 4 are determined by the external frame 9 and the reference parabola 4. The upper end point D and the lower end point F are determined as points where the reference parabola 4 intersects a curved surface which includes the external frame 9 and extends in parallel with the x-axis. A point E indicates a point where the x-y plane intersects the reference parabola 4.

(a6) To connect the points B and D, A and E, and C and F by circular arcs, respectively.

Figure 7:
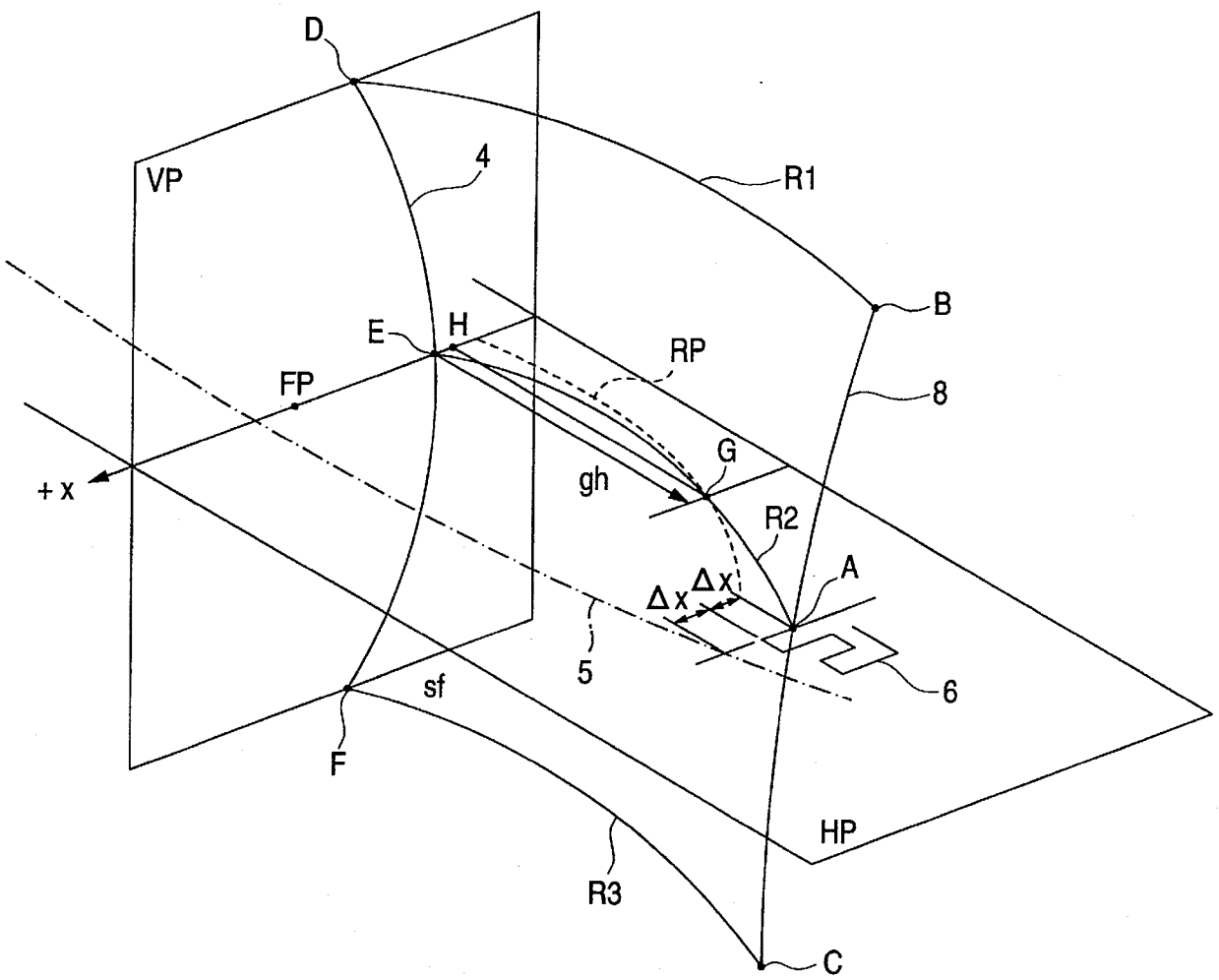
FIG. 7 is a perspective view showing how to form the right half of the curved surface of the reflecting surface.

As shown in FIG. 7, points B and D are connected by a circular arc R1; points A and E, by a circular arc R2; and points C and F, by a circular arc R3. In this case, the circular arcs R1 to R3 must satisfy the following conditions.

Condition 1: Those circular arcs do not interfere with members of the car body.

Condition 2: A point G where the paraboloid of revolution RP (indicated by a broken line) of the focal point FP and the focul distance fb (>fa) intersects the circular arc R2 is distanced from the x-axis as long as possible.

The condition 2 must be satisfied in order to increase a solid angle created when a viewer views the reflecting surface 1*a* from the light source, by expanding the region of the paraboloid of revolution RP of the focal distance fb. It is preferable to set the length gh of a line segment GH as long as possible where H indicates the foot of the perpendicular drawn from point G to the x-axis.

(a7) To generate a curved surface on the basis of the circular arcs R1, R2, R3, and R4, the curve 8, and the reference parabola 4.

A curved surface Sf is formed as a spline surface with boundary lines of the circular arcs R1, R2, R3, and R4, the curve 8, and the reference parabola 4.

(a8) To obtain a line of intersection of the curved surface Sf and the paraboloid of revolution RP.

Figure 8:
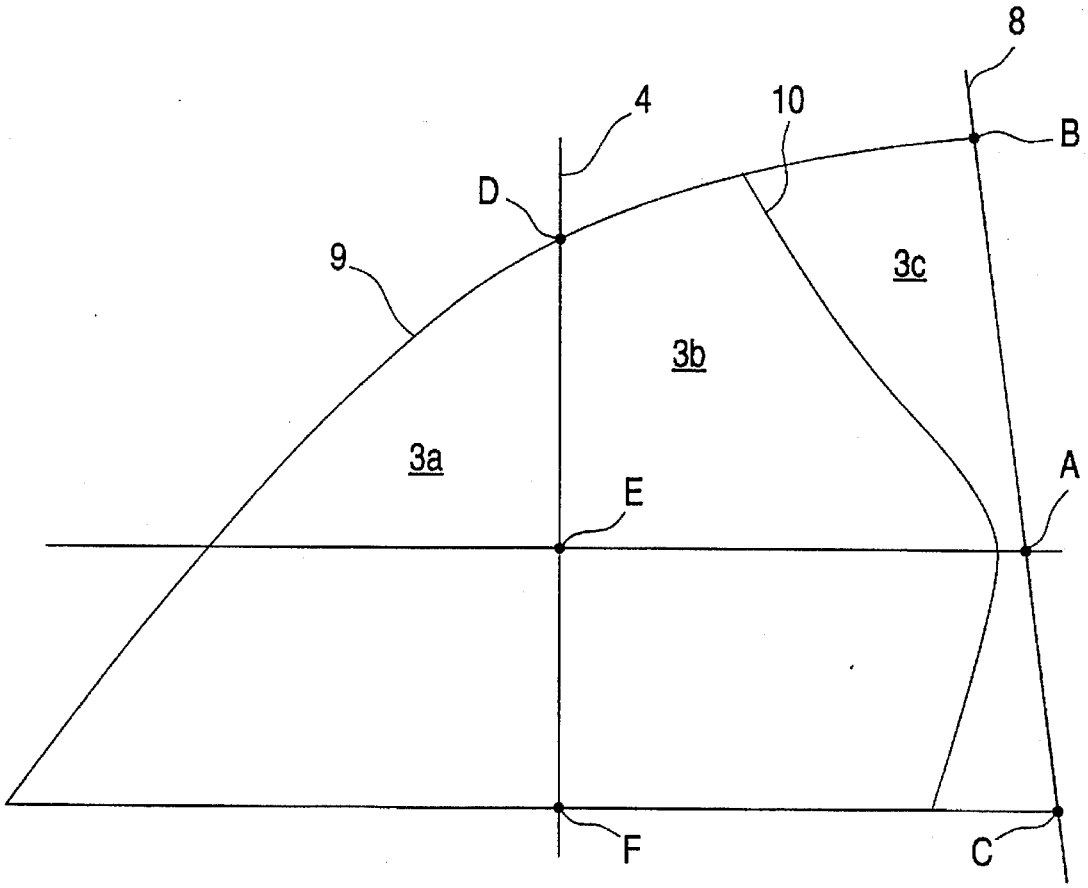
FIG. 8 is a front view showing an intersecting line where a curved surface Sf intersects a paraboloid of revolution RP.
Figure 9:
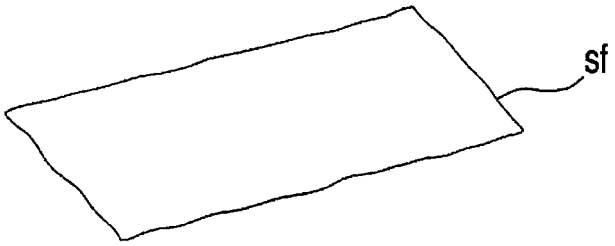
FIG. 9 is, together with FIGS. 10 to 14, a view for explaining a method of forming reflecting steps, and of these figures.

As the result of forming the intersecting line of the curved surface Sf and the paraboloid of revolution RP, a curve 10 outwardly curved as shown in FIG. 8 is formed as a boundary line between the regions 3*b* and 3*c*. The region 3*b* is continuous to the peripheral region 3*c* along the curve 10.

(a9) To assign curved surfaces to the regions located inside and outside the curve 10.

Design is made such that a shape of the inside region with respect to the curve 10 is curved to have the paraboloid of revolution of which the focal point is FP and the focal distance is fb, and a shape of the outside region forms a part of the curved surface Sf.

The sequence of the procedural steps thus far described completes the fundamental surface of the right half of the reflecting surface 1*a*. The thus obtained fundamental surface is formed as a surface which is irradiated by the light from the light source.

A sequence of procedural steps to form a plural number of reflecting steps on the peripheral region 3*c* will be described with reference to FIGS. 9 through 14. In order to facilitate understanding, the curved surface Sf is shaped into a surface resembling a flat plane in those figures.

(b1) To form a surface Sf as the fundamental surface.

The curved surface Sf formed through the procedural steps as mentioned above is set as shown in FIG. 9.

(b2) To form a group of the paraboloids of revolution.

Figure 10:
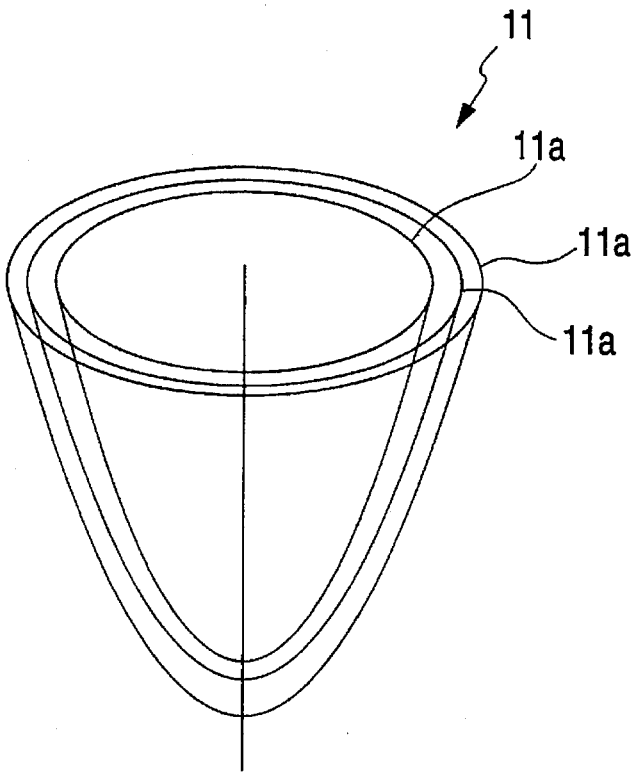
FIG. 10 is a view showing a group of paraboloids of revolution.
Figure 11:
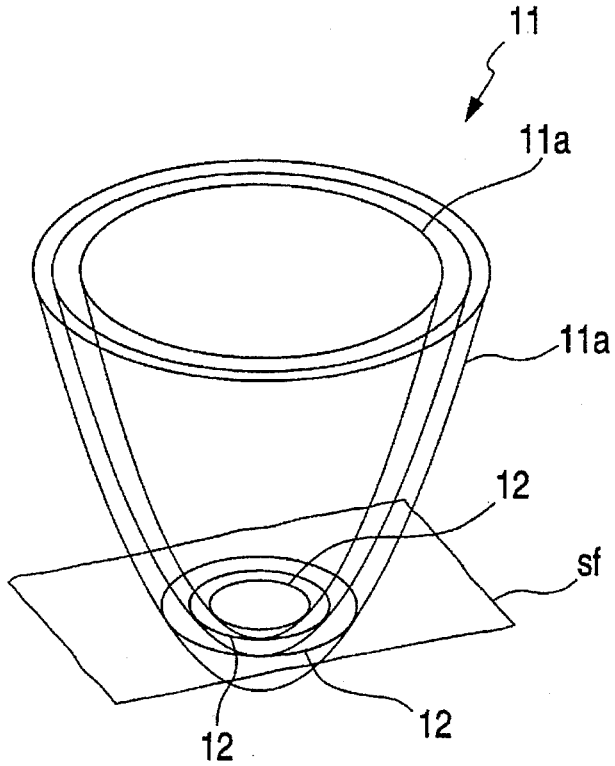
FIG. 11 is a view showing a group of intersecting lines where the fundamental surface intersects the paraboloids of revolution.

A group of paraboloids of revolution (the group is designated by reference numeral 11), which determine the light distribution performances of the reflecting surface, are formed as shown in FIG. 10. The group of paraboloids of revolution 11 consists of a plurality of paraboloids of revolution 11*a*, 11*b*, . . . , which have a common axis of rotational symmetry, and different focal distances (the focal points thereof are not always at the same position). Those paraboloids of revolution 11*a*, 11*b*, . . . are selected so as not to intersect with each other.

(b3) To generate a group of lines of intersection.

Intersecting lines 12 at which the curved surface Sf intersects the paraboloids of revolution 11 are determined. These intersecting lines 12 never intersect with each other.

Figure 12:
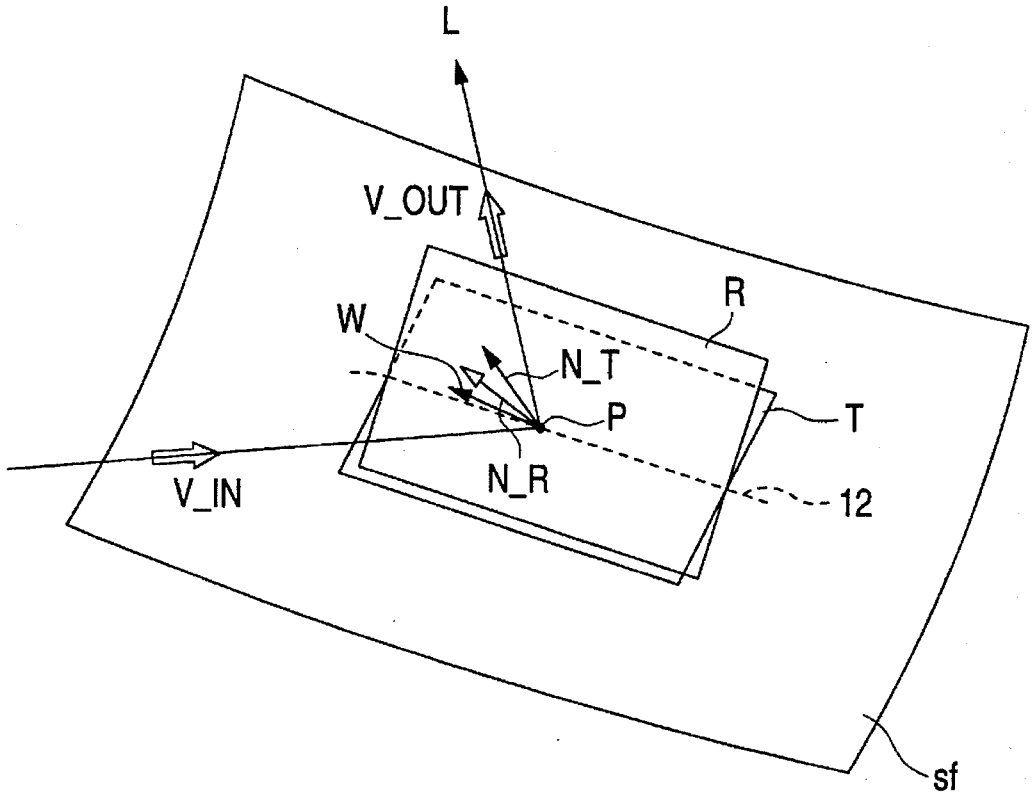
FIG. 12 is a perspective view showing how to form an intersecting line.

FIG. 12 is a view showing a local area of the curved surface Sf useful in explaining the formation of the intersecting lines 12. An optical path L on a point P on the curved surface Sf is illustrated. "V_IN" indicates a directional vector of an incident light beam that is emitted from a focal point of a paraboloid of revolution and goes to the point P. "V_OUT" indicates a directional vector of a reflecting light beam reflected at the point P. R is indicative of a micro-reflecting-surface enclosing the point P on the curved surface Sf. "N_R" represents a normal vector raised at the point P on the micro-reflecting-surface R. T is representative of a tangential plane at the point P on the curved surface Sf. "N_T" stands for a normal vector raised at the point P on the tangential plane T.

A vector W is the outer product of the normal vectors "N_R" and "N_T". The intersecting line 12 indicated by a broaken line is depicted as a spline curve by progressively using the outer product vector W as a tangential vector at the arbitrary point P.

(b4) To form reflecting steps.

Figure 13:
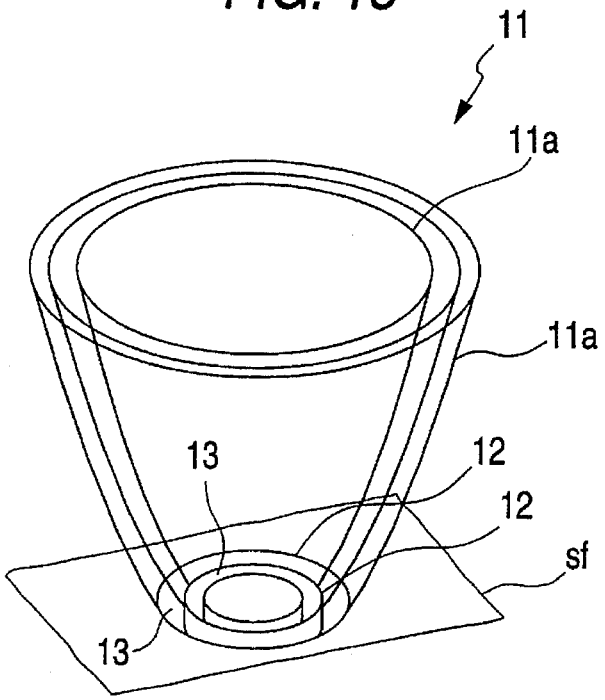
FIG. 13 is a view showing how to form reflecting steps along the intersecting lines.
Figure 14:
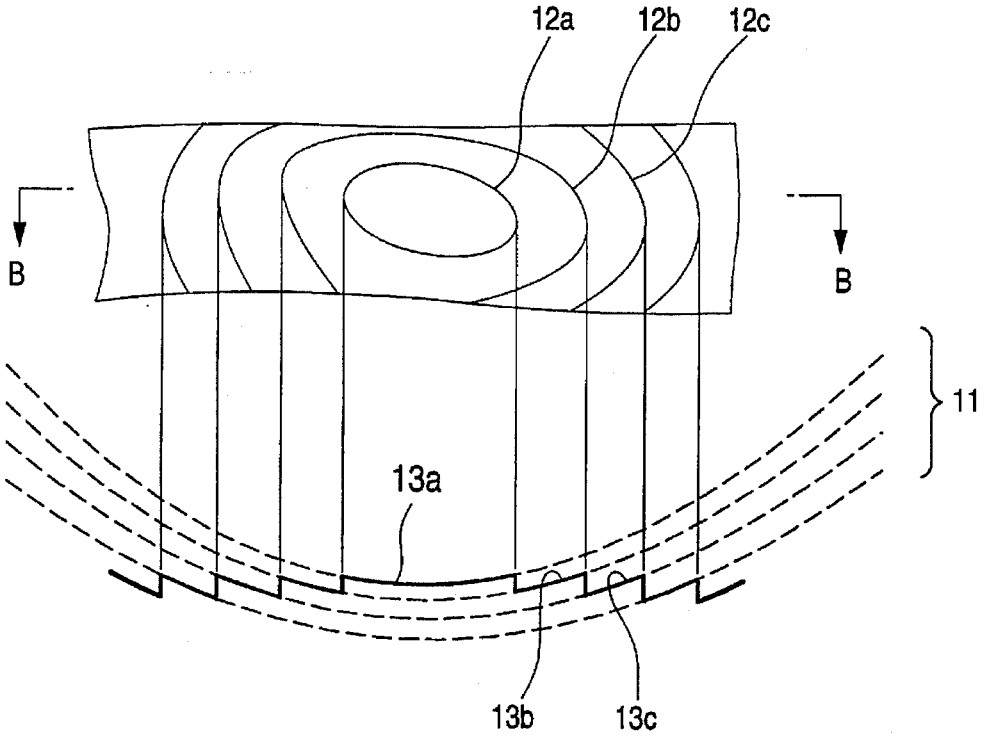
FIG. 14 is a view showing a front shape and a sectional shape of the reflecting steps.
Figure 15:
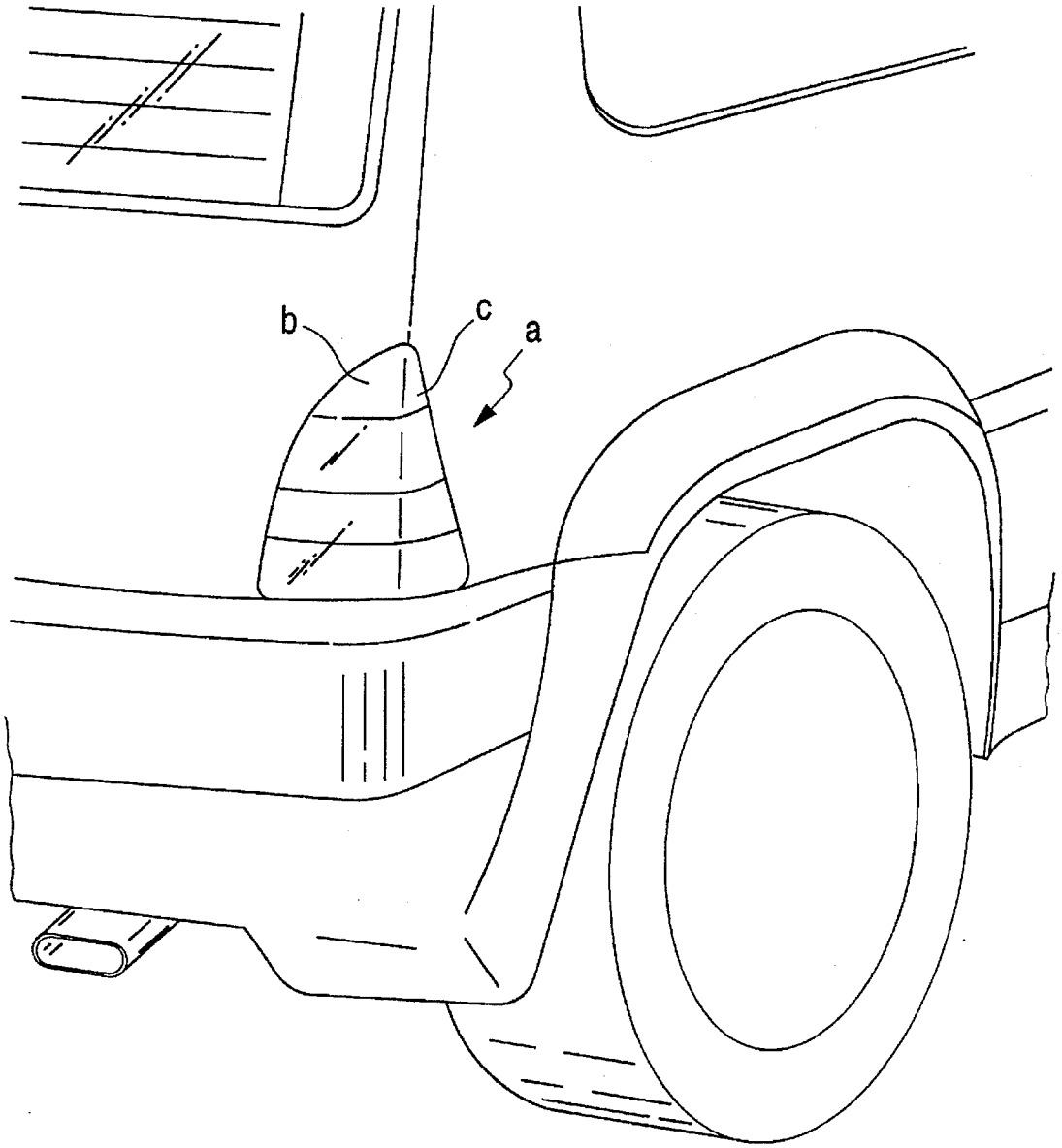
FIG. 15 is a perspective view showing a rear combination lamp mounted on one rear corner of a vehicle.
Figure 16:
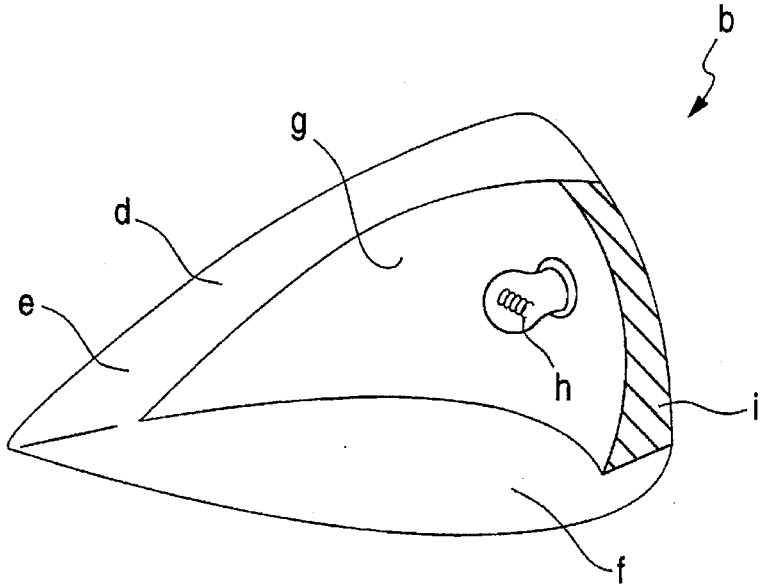
FIG. 16 PRIOR ART
FIG. 16 is a perspective view schematically showing a conventional vehicle lamp.
Figure 17:
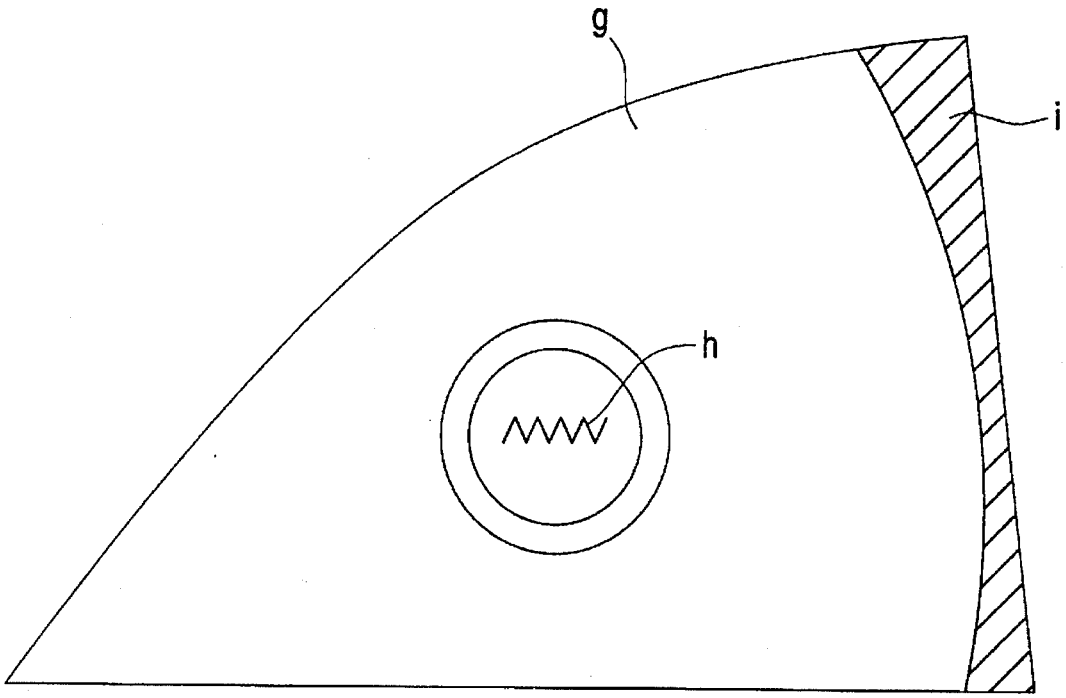
FIG. 17 PRIOR ART
FIG. 17 is a front view showing a reflector, the figure together with FIGS. 18 and 19 explaining the problems of the conventional art.
Figure 18:
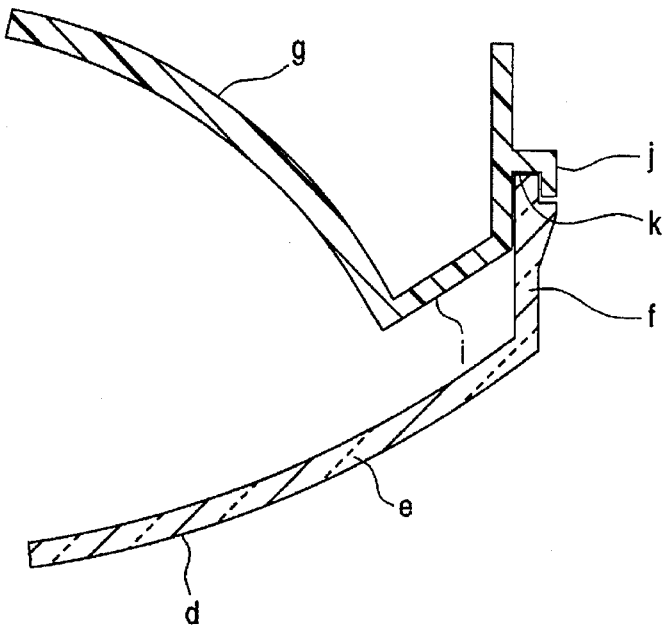
FIG. 18 PRIOR ART
FIG. 18 is a horizontal sectional view showing a main portion of a nonreflecting part and a lens mounting portion of a reflector.
Figure 19:
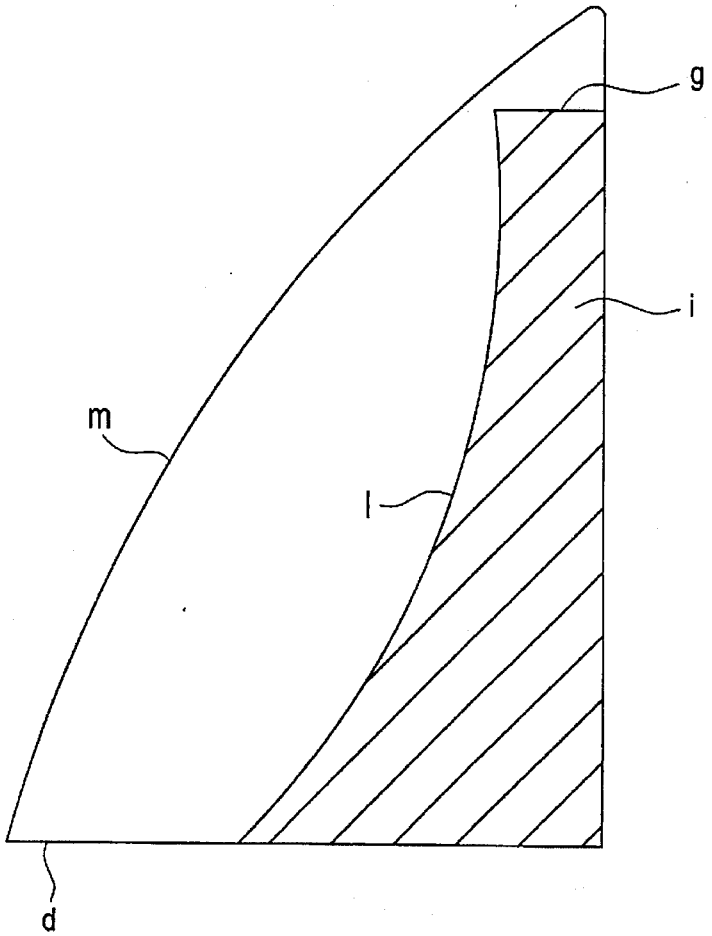
FIG. 19 PRIOR ART
FIG. 19 is a side view showing the relationship between the nonreflecting part of the reflector and a design line of an outer lens.

After the intersecting lines 12 are determined as described above, the reflecting steps are formed along these intersecting lines. As shown in FIG. 13, parts of the paraboloids of revolution 11 define the reflecting steps 13 between the adjacent intersecting lines. In FIG. 14, a front view showing a part of the curved surface Sf is illustrated in the upper portion thereof, and a cross sectional view taken on line B—B in the front view is illustrated in the lower portion thereof. The intersecting lines depicted on the curved surface Sf are denoted as 12*a*, 12*b*, 12*c*, . . . in the order from the inside thereof to the outside. These intersecting lines appear in the form of the boundary lines of the reflecting steps. In the figure, the curves indicated by broken lines indicate the paraboloids of revolution 11. The reflecting step 13*a* is formed within a region defined by the intersecting line 12*a*. The reflecting step 13*b* is formed in the region between the intersecting lines 12*a* and 12*b*. The reflecting step 13*c* is formed in the region between the intersecting lines 12*b* and 12*c*. That is, the reflecting steps are defined by the parts of the paraboloids of revolution with different focal distances, respectively. Those steps are stepwise shaped in cross section.

The reflecting surface la having the plural number of reflecting steps formed along the intersecting lines formed on the curved surface Sf thereof is formed by using a CAD system, to thereby generate CAM data for forming a die of the reflector 1.

As shown in FIG. 1, an intersecting line group 14 in the region 3*c* consists of curves 14*a*, 14*b*, 14*c*, . . . that are curved to expand to the right and do not intersect with each other. These curves are cut out along the boundary line at the right side of the peripheral region 3*c*, and at the upper and the lower sides thereof. That is, the intersecting line group 14 is basically a closed line group. The curves 14*a*, 14*b*, 14*c*, . . . are the parts of the group.

As seen from the method of forming the reflecting surface 1*a*, the region 3*b* close to the principal optical axis is shaped like the paraboloid of revolution. The fundamental surface of the peripheral region 3*c*, which is continuous to the region 3*b*, is formed by the curved surface Sf, which is smoothly continuous between its boundary line between the regions 3*b* and 3*c*, and its another boundary line along the design line of the outer lens. Therefore, the peripheral part of the reflecting surface la may be designed not to be shaded to the light from the light source. In this case, the intersecting line of the curved surface Sf and the paraboloid of revolution RP is spaced apart from the principal optical axis as long as possible. By so doing, a solid angle created when a viewer views the right half of the reflecting surface 1*a* from the light source, is increased. Parts of the paraboloids of revolution define a plurality of reflecting steps along the intersecting lines at which the peripheral region 3*c* intersects the paraboloids of revolution 11. With the provision of the reflecting steps, light beams are directed in the principal optical axis. Thus, the reflecting surface 1*a* can be shaped so that no nonreflecting part is formed in the peripheral region of the reflecting surface 1*a* of the reflector. Further, the curve 8 that demarcates the right side of the peripheral region 3*c* is harmonized with the design curve 7 of the outer lens, in shape. Therefore, the vehicle lamp of the present invention is free from the problem of the unattractive appearance of the peripheral region of the reflector 1 when viewed from the side of the car.

In the vehicle lamp of the present invention, the first region is curved to have the paraboloid of revolution. The peripheral region continuous to the first region is shaped to have a curved surface being smoothly continuous between the boundary line of the peripheral region to the first region and the boundary line of the peripheral region extended along the design line of the outer lens. Therefore, a part shaded to light from the light source is not formed on the peripheral region of the reflecting surface. Further, parts of the paraboloids of revolution define a plurality of reflecting steps in the peripheral region along the intersecting lines and between the adjacent intersecting lines. With the provision of the reflecting steps, light beams are directed in the principal optical axis. Thus, the reflecting surface can be shaped so that nonreflecting part is not created in the peripheral region of the reflecting surface. Additionally, the boundary line that demarcates the right side of the peripheral region is harmonized with the design line of the outer lens in shape when viewed from the side of the car. Thus, an attractive appearance of the peripheral region of the reflector 1 when viewed from the side of the car, is secured.

What is claimed is:

1. A vehicle lamp comprising:

a reflector having a reflecting surface, said reflecting surface having a first region which is curved to have a paraboloid of revolution, and a peripheral region which is located adjoining to said first region, is curved to have a free curved surface, and has a plurality of reflecting steps, at least one point in said first region being closer to a principal optical axis of said reflector than any points in said peripheral region;

an outer lens covering an opening of said reflector; and a light source disposed near a focal point of said first region of said reflecting surface;

wherein said peripheral region of said reflector is continuous to said first region;

wherein a first boundary line at an end of said peripheral region separate from said first region is shaped along a design line of said outer lens when viewed from a side of said vehicle lamp; and wherein said reflecting steps are disposed on said peripheral region along intersecting lines at which said peripheral region intersects a plurality of paraboloids of revolution with different focal distances, and between adjacent ones of said intersecting lines, said reflecting steps being defined by parts of said paraboloids of revolution.

2. A method of forming the reflector of the vehicle lamp as claimed in claim 1, comprising the steps of:

1) drawing a reference parabola of the same focal point as that of said first region in a vertical plane containing said principal optical axis of said reflector;

2) determining a reference point of said first boundary line between a lens mounting portion for mounting said outer lens and said peripheral region in a horizontal plane containing said principal optical axis of said reflector;

3) setting up said first boundary line of said peripheral region along a design line of said outer lens when viewed from the side of said vehicle lamp, said first boundary line passing through said reference point determined in step 2);

4) determining first end points of said first boundary line determined in step 3) on the basis of said first boundary line and an external frame of said reflector when viewed from a front side thereof;

5) determining second end points of said reference parabola and an intersecting point where the horizontal plane containing said principal optical axis intersects said reference parabola, said second end points being determined on the basis of said external frame of said reflector and said reference parabola drawn in step 1);

6) connecting, by circular arcs, the associated points in a vertical direction, said points including said reference point determined in step 2), said first end points determined in step 4) and said second end points and said intersecting point determined in step 5);

7) generating a curved surface on the basis of said circular arcs used in step 6), said reference parabola drawn in step 1), and said first boundary line set up in step 3);

8) obtaining a line of intersection of said curved surface generated in step 7) and a paraboloid of revolution of which a focal point and a focal distance are the same as those of said first region, to thereby determine a second boundary line between said first region and said peripheral region, wherein said first region is curved to have said paraboloid of revolution, and said peripheral region forms a part of said curved surface generated in step 7);

9) setting a plurality of paraboloids of revolution with different focal distances for said peripheral region;

10) determining intersecting lines where said peripheral region intersects said plurality of paraboloids of revolution; and 11) defining a plurality of reflecting steps by parts of said paraboloids of revolution, said reflecting steps being disposed on said peripheral region along said intersecting lines and between said adjacent intersecting lines.

3. A vehicle lamp as claimed in claim 1, wherein said first region is shaped into said paraboloid of revolution so that light beams from said light source are reflected by said first region substantially along said principle optical axis, and said plurality of reflecting steps are disposed in said peripheral region so that light beams from said light source are reflected by said peripheral region substantially along said principle optical axis, whereby said reflector produces substantially parallel light beams.

* * * * *